United States Patent [19]

Vicard

[11] 4,380,189

[45] Apr. 19, 1983

[54] INDUSTRIAL CHIMNEYS WITH FORCED DRAUGHT

[75] Inventor: Jean-Francois Vicard, Lyons, France

[73] Assignee: Societe Lab, Lyons, France

[21] Appl. No.: 260,442

[22] Filed: May 4, 1981

[30] Foreign Application Priority Data

May 9, 1980 [FR] France ..... 80 10971

[51] Int. Cl.[3] ..... F23L 17/02

[52] U.S. Cl. ..... 98/58; 110/160

[58] Field of Search ..... 52/218; 98/58, 60, 78, 98/80; 110/160, 184

[56] References Cited

U.S. PATENT DOCUMENTS

| | | | |
|---|---|---|---|
| 3,566,768 | 3/1971 | Walpole, Jr. | 98/58 |
| 3,606,847 | 9/1971 | Reilly | 110/160 |
| 3,670,666 | 6/1972 | Hermann | 110/160 X |
| 4,149,453 | 4/1979 | Reed | 110/160 X |

FOREIGN PATENT DOCUMENTS

| | | | |
|---|---|---|---|
| 445125 | 5/1927 | Fed. Rep. of Germany | 98/58 |
| 2730582 | of 1977 | Fed. Rep. of Germany . | |
| 1056616 | of 1952 | France . | |
| 1350587 | of 1963 | France . | |
| 2122026 | of 1972 | France . | |

*Primary Examiner*—Albert J. Makay
*Assistant Examiner*—Harold Joyce
*Attorney, Agent, or Firm*—Dowell & Dowell

[57] ABSTRACT

A chimney comprises a central column through which the combustion gases or the like are forced, this column terminating at its upper end in a nozzle of smaller cross-section, and an outer wall which surrounds the column while leaving an annular intermediate space into which air is forced under a pressure slightly above the pressure of the combustion gases within the central column, this outer wall joining the periphery of the column in the zone of the upper nozzle. Apertures are provided in the wall of the column just below the nozzle to connect the annular space and the inside of the column. Air is thus introduced centripetally into the stream of combustion gases, a part of this air becoming progressively mixed with the said gases while another part forms a protective thermally insulating sleeve around the jet of these gases which issues from the nozzle, thus delaying the condensation of water droplets and the formation of a white cloud, which therefore only appears at a substantial height above the top of the chimney.

1 Claim, 2 Drawing Figures

INDUSTRIAL CHIMNEYS WITH FORCED DRAUGHT

The present invention relates to industrial chimneys adapted to discharge into the atmosphere gaseous products which are to be disposed of, the term gaseous products including here vapours and solid or liquid particles in suspension in a gas. The most frequent case concerns combustion products from furnaces and the like.

In order to reduce to a minimum the inconveniences, and more particularly pollution, which such products may cause, it is important that the corresponding chimneys should be as high as possible, which of course entails considerable costs.

To avoid this drawback it has been proposed to eject the gaseous products under pressure through an appropriate nozzle in the form of a high velocity jet which rises high in the atmosphere before becoming mixed with the surrounding air. It has also been proposed to use auxiliary air jets which entrain more or less satisfactorily the gaseous products. In actual practice these solutions have been expensive and have required a high consumption of power, while giving rather poor results.

It is the object of the present invention to avoid these inconveniences.

In a chimney according to the invention, for the discharge of gaseous products such as combustion gases into the surrounding atmosphere, of the kind in which in order to raise the level of the cloud of smoke and/or water droplets an auxiliary gas such as air is blown in the zone of its upper outlet to realize a jet or jets which surround at least part of the periphery of a central jet formed by the said gaseous products, means are provided to introduce the auxiliary gas in a centripetal direction into the flow of the said gaseous products, at a small distance below the said upper outlet.

Figures 1, 2:
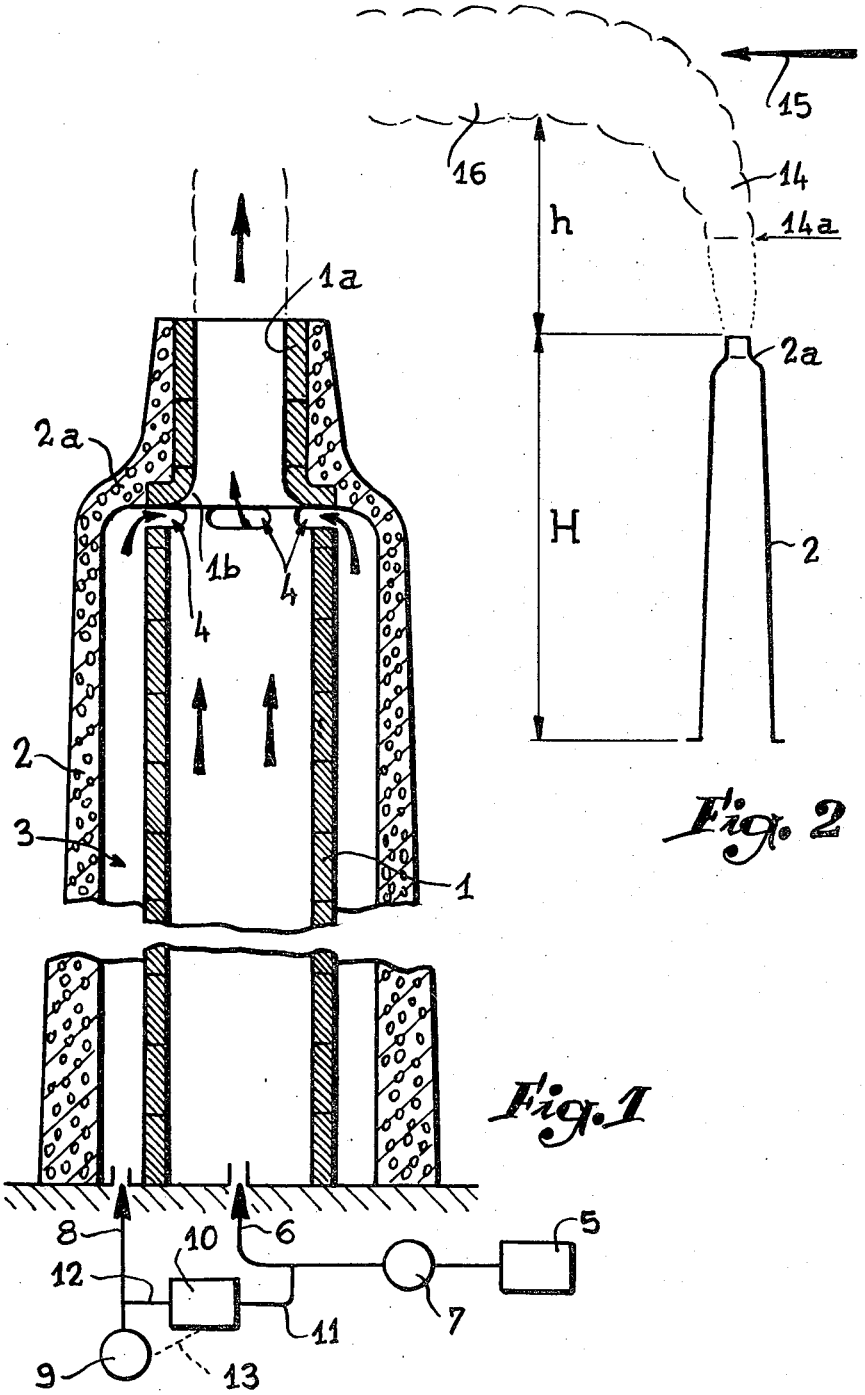
FIG. 1 is a vertical section of a chimney according to the invention, this view indicating diagrammatically the plant with which this chimney is associated.
FIG. 2 shows diagrammatically how this chimney operates.

The chimney illustrated in FIG. 1 comprises a central column 1 realized in any appropriate material, as for instance bricks, and an outer wall made for instance of reinforced or non re-inforced concrete, this wall surrounding the column while leaving an annular intermediate space 3. Column 1 terminates at its higher end in a portion 1*a* of lesser diameter adapted to form an upwardly directed nozzle. In the embodiment illustrated this portion is cylindrical, but it would also be possible to make it convergent at least along part of its height. As to the outer wall 2 it joins the periphery of column 1 adjacent the base of the portion or nozzle 1*a*, as shown at *2a*.

The connection between column 1 and nozzle 1*a* is in the form of a rounded portion 1*b* and immediately below this rounded portion the apertures 4 provide a communication between annular space 3 and the inside of column 1.

The furnace or other apparatus 5 which generates the gaseous products which are to be discharged is connected with the base of column 1 by a conduit or flue 6 (diagrammatically illustrated by a single line) including a blower 7 in such manner as to realize what is known as a forced draught. Conduit 6 could of course also be provided with filtering, purifying, cooling, drying devices or the like as may be desired. The intermediate annular space 3 receives pressurized air through a conduit 8 from a blower 9. There is further provided a pressure comparator 10 respectively connected with conduits 6 and 8 by lines 11 and 12, this comparator controlling blower 9 through an appropriate system, as for instance mechanical or electric, which has been diagrammatically indicated by the broken line 13.

In operation blower 7 forces the gaseous products to be discharged into the base of column 1 under a given pressure. At the same time blower 9 forces air into the intermediate annular space 3 under a pressure which is maintained by comparator 10 very slightly higher than the outlet pressure of blower 7. Under these conditions air from space 3 flows centripetally through apertures 4 and becomes mixed at least in part with the mass of gaseous products which rise within column 1, the mixture flowing at a high velocity through nozzle 1*a* in which the static pressure is transformed into dynamic pressure, i.e. into kinetic energy.

It is however very important to note that actually the air issuing from apertures 4 flows preferentially along the inner surface of nozzle 1*a*, so that the gas jet which issues from the nozzle comprises a peripheral portion or sleeve which is almost formed of pure air. Such a composite jet has a number of advantages:

1° Owing to the fact that a portion of the air from space 3 becomes mixed with the gaseous products to be discharged, the jet issuing from nozzle 1*a* comprises no discontinuity in the transverse direction. In other words there is no border line or gap between the outer sleeve predominantly formed of air and the central core predominantly formed of combustion products.

2° The air sleeve of almost uncontaminated air which surrounds the central core predominantly formed of gaseous products to be discharged is relatively dry and thermically insulating. It therefore considerably delays the condensation phenomena which thus only appear well above nozzle 1*a*.

3° Owing to the connection which apertures 4 realize between the annular space 3 and the inside of column 1, a process of self-regulation appears at the inlet of nozzle 1*a* between the respective pressures of air and of gaseous products to be discharged. The air flow rate through apertures 4 is not controlled by the outlet pressure of blower 9, but by the pressure difference between this pressure and the forced draught pressure generated by blower 7. Consequently the head losses between the outlet of air blower 9 and the outlets of the said apertures 4 is also dependent of this difference. It results from these considerations that the minor errors in the operation of comparator 10 when the working conditions vary in the furnace 5 are automatically compensated by changes in the aforesaid head losses. Assuming for instance that the working pressure of the furnace decreases together with the forced draught pressure in column 1, if comparator 10 imparts to blower 9 a too high outlet pressure, the head losses increase to efficiently limit the resulting high air flow.

It should further be remarked that the presence of air under a slight overpressure within space 3 avoids any outward leakage of humidity through the joints of column 1 (more particularly when this latter is made of bricks). Furthermore the said column 1 is subjected on its outside and its inside to pressures which are almost equal, with the inwardly directed pressure being slightly predominant and therefore any risk of bursting is avoided. As to the outer wall 2, even if it has some slight defects, this is of minor importance since the fluid which may thus escape outwarly is pure air.

FIG. 2 diagrammatically illustrates the configuration of the composite gas jet 14 which issues from a chimney according to the invention. The height of this chimney has been referenced H. The issuing gas jet 14, comprising a core of gaseous combustions gases or the like and an air sleeve, first rises almost vertically and thereafter progressively follows a curved path under the action of wind (illustrated by arrow 15). The substantially horizontal cloud 16 of smoke particles and condensed water droplets only appears at a height h above the outlet of nozzle 1*a*, whereby the chimney described behaves as a conventional chimney having the height H+h. It should further be remarked that owing to the delayed condensation due to the insulating air sleeve, jet 14 is initially perfectly transparent and practically invisible. It only becomes white in a very progressive manner, as for instance starting from the level referenced 14*a*. It is besides possible to enhance this effect of the auxiliary air stream by pre-treating the air forced into space 3, as for instance by drying and/or heating it.

It should besides be noted in this respect that the air which issues through apertures 4 is automatically preheated in a noticeable manner by heat exhange with the combustion gases through the wall of column 1. This has the advantage of reducing the power required to bring this air to a pre-determined temperature, and also of cooling the said wall, thus preventing any possible excessive temperature in the case of very hot combustion gases.

I claim:

1. A forced-draught chimney for the discharge of gaseous products from a source into the atmosphere, comprising:

a substantially vertical column having a lower end and an upper end, and the column defining an inner space having a first inner diameter at its upper end;

a substantially vertical discharge nozzle extending coaxially upwardly from said column, the nozzle having a lower portion joining the upper end of the column and having an opening therethrough communicating with the inner space of the column, the lower portion of the nozzle opening being rounded to decrease upwardly from a lower inner diameter of the nozzle equal to said first diameter of the column to a second inner diameter of the upper portion of the nozzle which is smaller than said first diameter;

an outer wall surrounding and enclosing the upper end of the column and defining with the column an intermediate annular space which is closed at the top of the column;

the upper end of the column having around its entire periphery centripetally directed apertures extending therethrough immediately below the rounded lower portion of the nozzle, and communicating from the intermediate space into the inner space of the column where it joins the nozzle;

means operative to force gaseous products under pressure into the inner space of the column; and means operative to force an auxiliary gas under pressure into the intermediate space, the auxiliary gas pressure being slightly greater than the pressure of the gaseous products in the column to cause said auxiliary gas to flow centripetally through said apertures and thereafter to surround said gaseous products with a continuous thermally-insulating sleeve and to rise with said gaseous products upwardly through the decreased diameter nozzle which transforms static gas pressures into upward kinetic energy.

* * * * *